US008272355B2

(12) United States Patent
Byeon

(10) Patent No.: US 8,272,355 B2
(45) Date of Patent: Sep. 25, 2012

(54) VARIABLE COMPRESSION RATIO APPARATUS AND ENGINE USING THE SAME

(75) Inventor: Ki Wook Byeon, Hwaseong (KR)

(73) Assignee: Hyundai Motor Company, Seoul (KR)

( * ) Notice: Subject to any disclaimer, the term of this patent is extended or adjusted under 35 U.S.C. 154(b) by 624 days.

(21) Appl. No.: 12/480,468

(22) Filed: Jun. 8, 2009

(65) Prior Publication Data

US 2010/0006070 A1 Jan. 14, 2010

(30) Foreign Application Priority Data

Jul. 11, 2008 (KR) ..... 10-2008-0067695

(51) Int. Cl.
*F02B 75/04* (2006.01)

(52) U.S. Cl. ..... 123/48 B; 123/48 A; 123/78 B

(58) Field of Classification Search ..... 123/48 B, 123/48 R, 48 A, 78 B, 78 BA, 78 E
See application file for complete search history.

(56) References Cited

U.S. PATENT DOCUMENTS 4,738,230 A * 4/1988 Johnson ..... 123/48 B
4,834,031 A * 5/1989 Katoh et al. ..... 123/48 R
5,025,757 A * 6/1991 Larsen ..... 123/48 R
5,146,884 A * 9/1992 Merkel ..... 123/197.4
5,201,287 A * 4/1993 Blish ..... 123/48 B
5,724,935 A * 3/1998 Routery ..... 123/197.4
6,386,153 B1 * 5/2002 Rao et al. ..... 123/48 B
6,396,153 B2 * 5/2002 Fillion et al. ..... 257/774
6,990,933 B2 * 1/2006 Casterline ..... 123/48 B
7,055,469 B2 * 6/2006 Lawrence et al. ..... 123/48 AA
7,240,646 B2 * 7/2007 Watanabe et al. ..... 123/48 B

FOREIGN PATENT DOCUMENTS

KR 1999-005205 A 1/1999
KR 10-0230055 B1 11/1999

* cited by examiner

*Primary Examiner* — Noah Kamen
*Assistant Examiner* — Long T Tran
(74) *Attorney, Agent, or Firm* — Morgan, Lewis & Bockius LLP

(57) ABSTRACT

A variable compression ratio apparatus, and an engine using the same, is configured to change the compression ratio of an air-fuel mixture in a combustion chamber according to a driving condition of an engine. The variable compression ratio apparatus may be mounted at an engine receiving a combustion force of an air-fuel mixture from a piston so as to rotate a crankshaft disposed between cylinder blocks, wherein the variable compression ratio apparatus changes the compression ratio of the air-fuel mixture by changing the mounting height of the crankshaft according to a driving condition of the engine.

13 Claims, 8 Drawing Sheets

VARIABLE COMPRESSION RATIO APPARATUS AND ENGINE USING THE SAME

CROSS-REFERENCE TO RELATED APPLICATION

The present application claims priority to Korean Patent Application Number 10-2008-0067695 filed Jul. 11, 2008, the entire contents of which application is incorporated herein for all purposes by this reference.

BACKGROUND OF THE INVENTION

1. Field of the Invention

The present invention relates to a variable compression ratio apparatus, and an engine using the same. More particularly, the present invention relates to a variable compression ratio apparatus and an engine using the same that change compression ratio of an air-fuel mixture in a combustion chamber according to a driving condition of an engine.

2. Description of Related Art

Generally, thermal efficiency of combustion engines increases as the compression ratio thereof increases, and if ignition timing is advanced to some degree, thermal efficiency of spark-ignition engines increases. However, if the ignition timing of the spark-ignition engines is advanced at a high compression ratio, abnormal combustion may occur and the engine may be damaged. Thus, the ignition timing cannot be excessively advanced and accordingly engine output may deteriorate.

A variable compression ratio (VCR) apparatus changes the compression ratio of an air-fuel mixture according to a driving condition of the engine. The variable compression ratio apparatus raises the compression ratio of the air-fuel mixture at a low-load condition of the engine in order to improve fuel mileage. On the contrary, the variable compression ratio apparatus lowers the compression ratio of the air-fuel mixture at a high-load condition of the engine in order to prevent occurrence of knocking and improve engine output.

Currently, diesel engines achieve low-temperature combustion by enlarging the volume of a combustion chamber and by lowering the compression ratio in order to meet intensified exhaust gas regulations. However, since startability at a cold temperature deteriorates as the compression ratio decreases, a glow plug system must be made of ceramic materials so as to strengthen them and an additional control unit for controlling the glow plug system is required. Thus, production costs may increase.

In addition, since the compression ratio is fixed, an optimal compression ratio according to a various driving conditions may not be achieved.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable compression ratio apparatus and an engine using the same having advantages of enhancing fuel mileage and output as a consequence of changing the compression ratio of an air-fuel mixture according to a driving condition of an engine.

In an aspect of the present invention, a variable compression ratio apparatus may be mounted at an engine receiving a combustion force of an air-fuel mixture from a piston so as to rotate a crankshaft, wherein the crankshaft is movably disposed between cylinder blocks and configured and dimensioned to change a position of a rotation center of the crankshaft such that the compression ratio of the air-fuel mixture is changed by the position of the rotation center of the crankshaft according to a driving condition of the engine.

The variable compression ratio apparatus may further include a guide hole formed in the cylinder blocks and slidably receiving the crankshaft therein so as to allow upward and downward movements of the crankshaft to change the rotation center of the crankshaft, an operating cylinder formed in one of the cylinder blocks and connected to the guide hole and receiving hydraulic pressure according to the driving condition of the engine, and an operating piston slidably mounted in the operating cylinder and selectively pressing the crankshaft to change the rotation center of the crankshaft by the hydraulic pressure along the guide hole, wherein the operating cylinder includes a spacer therein to maintain a gap between the operating piston and a inlet portion of the hydraulic pressure supplied through the operating cylinder.

The variable compression ratio apparatus may further include a mounting hole formed to the other one of the cylinder blocks, an elastic member disposed in the mounting hole and exerting elastic force against the hydraulic pressure to the crankshaft, and an upper piston slidably disposed in the mounting hole and supported by the elastic member so as to supply the elastic force to the crankshaft, wherein a hollow bearing having substantially the same shape of the guide hole is mounted in the guide hole of the cylinder blocks, and wherein the crankshaft is rotatably inserted in the bearing, wherein the guide hole and the hollow bearing are shaped eccentric such that the crankshaft is configured and dimensioned to be slidably movable therein, wherein upper and lower rollers are rotatably mounted respectively at the upper piston and the operating piston, and wherein the upper and lower rollers rotatably contact with the crankshaft respectively through upper and lower penetration holes formed on the hollow bearing.

In another aspect of the present invention, the variable compression ratio apparatus may further include at least an elastic member exerting elastic force against the hydraulic pressure, which may include a supporting member mounted in the guide hole of the cylinder block and configured and dimensioned to move upwardly or downwardly therein, wherein the crankshaft is rotatably inserted in a receiving hole of the supporting member so as to move together with the supporting member.

The elastic members may be disposed between upper portion of the guide hole and the supporting member and are aligned symmetric with respect to the center axis of the supporting member in a longitudinal direction of the supporting member and exerting an elastic force against the hydraulic pressure to the supporting member.

The operating piston may contact with a lower surface of the supporting member and the elastic member contacts with an upper surface of the supporting member such that the operating piston and the elastic member respectively exert the hydraulic pressure and the elastic force opposing each other to the supporting member, wherein the supporting member and operating cylinder are monolithically formed.

A hollow bearing is disposed in the receiving hole of the supporting member, wherein the supporting member includes an upper supporting member and a lower supporting member coupled to the upper supporting member and the bearing is disposed in the receiving hole formed in the upper and lower supporting members.

In further another aspect of the present invention, an engine may include a piston receiving a combustion force of an air-fuel mixture, a crankshaft receiving the combustion force of the air-fuel mixture from the piston through a connecting rod and thereby being rotated, a variable compression ratio apparatus changing a compression ratio of the air-fuel mixture, a hydraulic pump generating hydraulic pressure supplied to the variable compression ratio apparatus, and a control portion controlling the hydraulic pressure generated in the hydraulic pump according to a driving condition of the engine.

The control portion may control the hydraulic pressure such that a maximum compression ratio should be achieved in a case in which the driving condition of the engine satisfies a predetermined driving condition, wherein the control portion controls the hydraulic pressure such that the compression ratio of the air-fuel mixture according to the driving condition of the engine should be achieved in a case in which the driving condition of the engine does not satisfy the predetermined driving condition, and wherein the predetermined driving condition is satisfied when a coolant temperature is lower than or equal to a predetermined temperature and an engine speed is slower than or equal to a predetermined speed.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
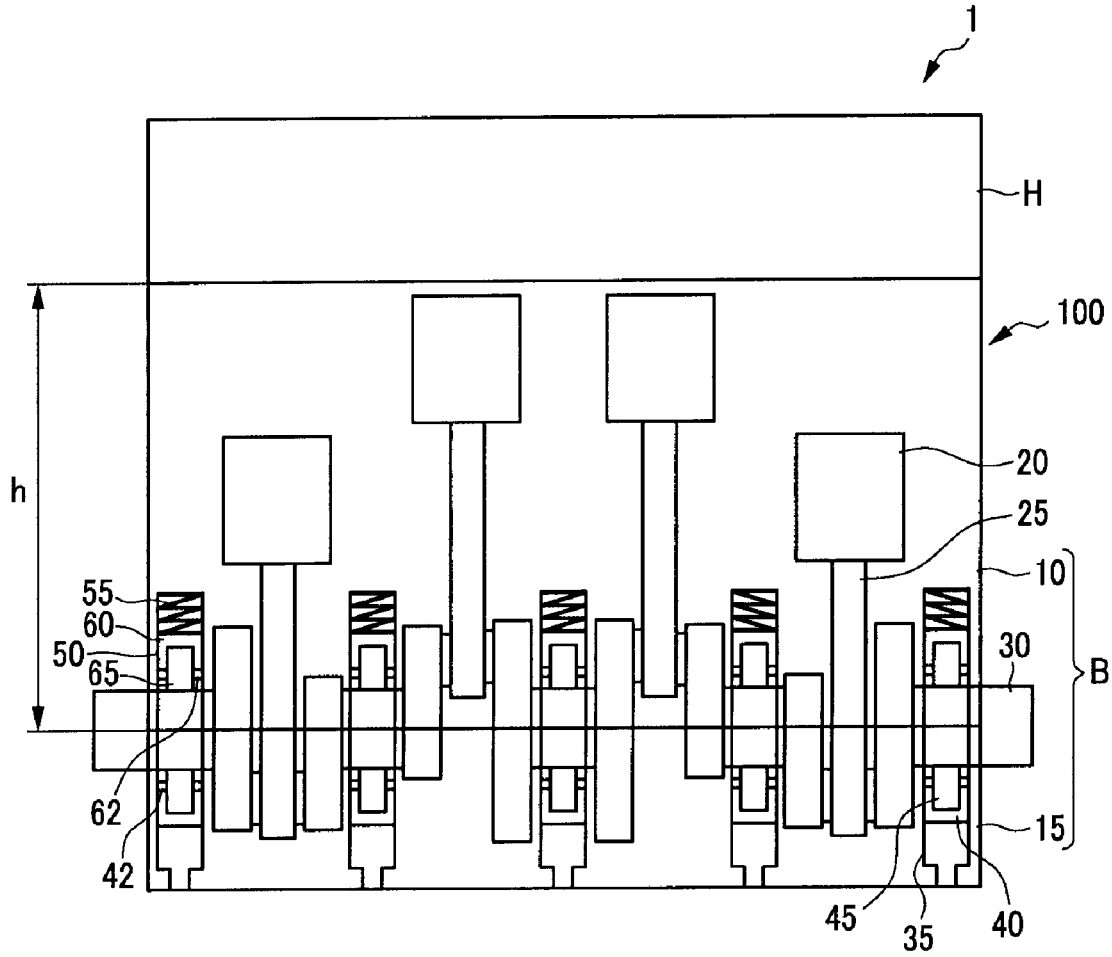
FIG. 1 is a schematic diagram of an exemplary variable compression ratio apparatus according to the present invention.
Figure 2:
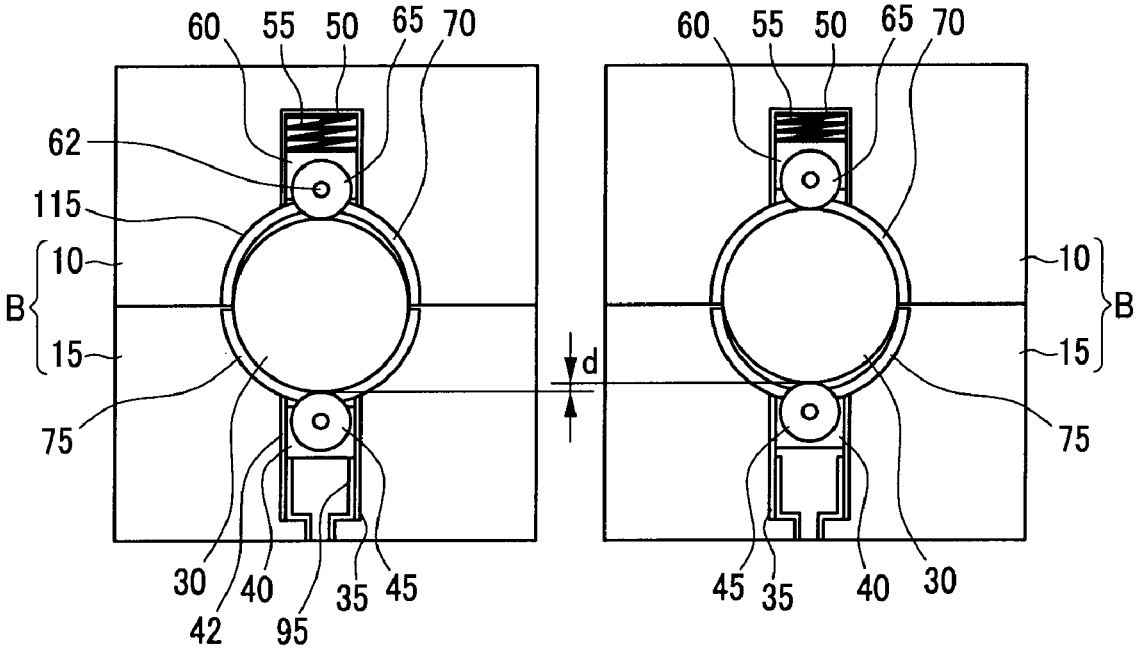
FIG. 2 is a side cross-sectional view of the variable compression ratio apparatus of FIG. 1.
Figure 3:
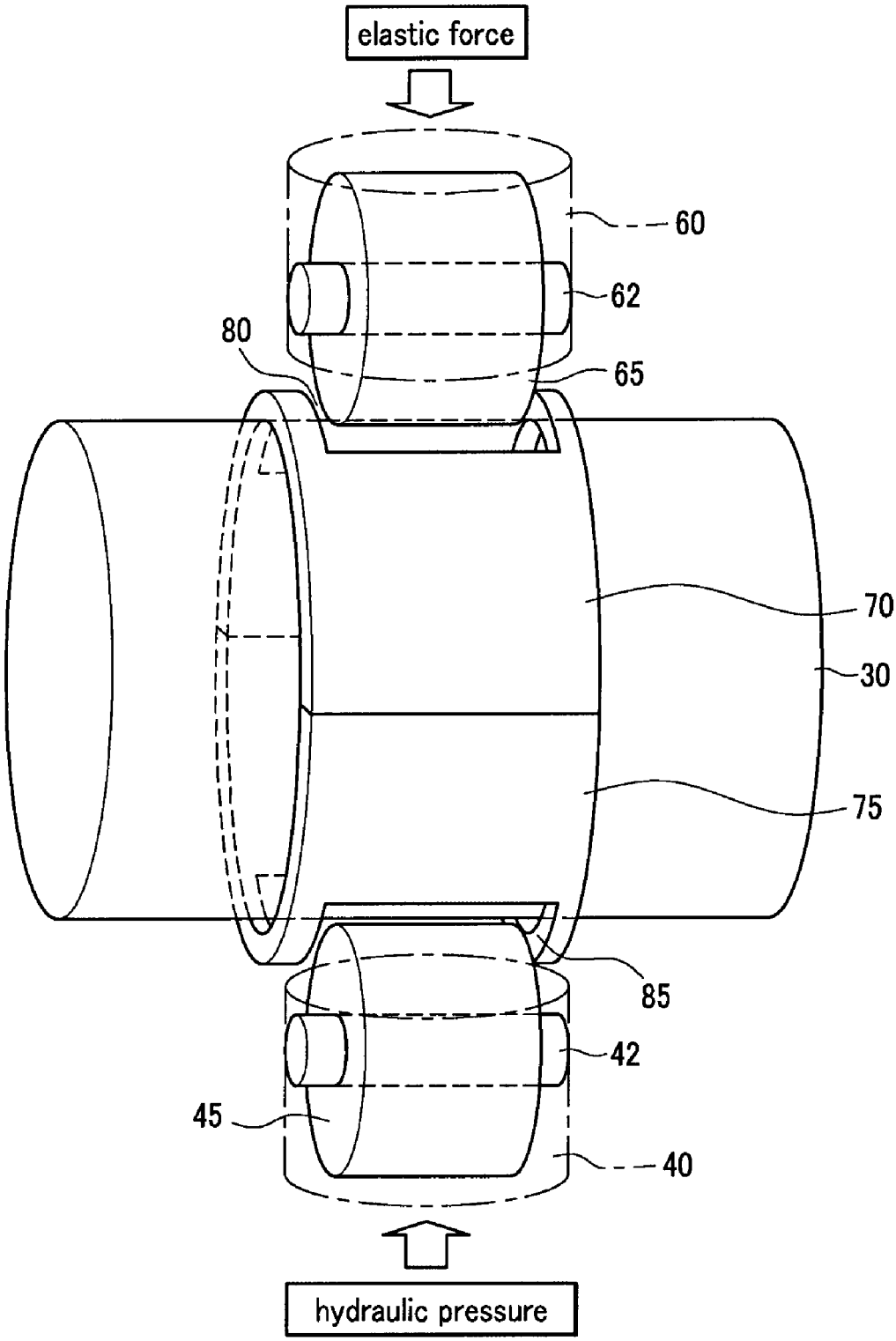
FIG. 3 is a schematic diagram showing an operation of the variable compression ratio apparatus of FIG. 1.

FIG. 1 is a schematic diagram of a variable compression ratio apparatus according to various embodiments of the present invention, FIG. 2 is a side cross-sectional view of a variable compression ratio apparatus according to various embodiments of the present invention, and FIG. 3 is a schematic diagram showing an operation of a variable compression ratio apparatus according to various embodiments of the present invention.

Figure 6:
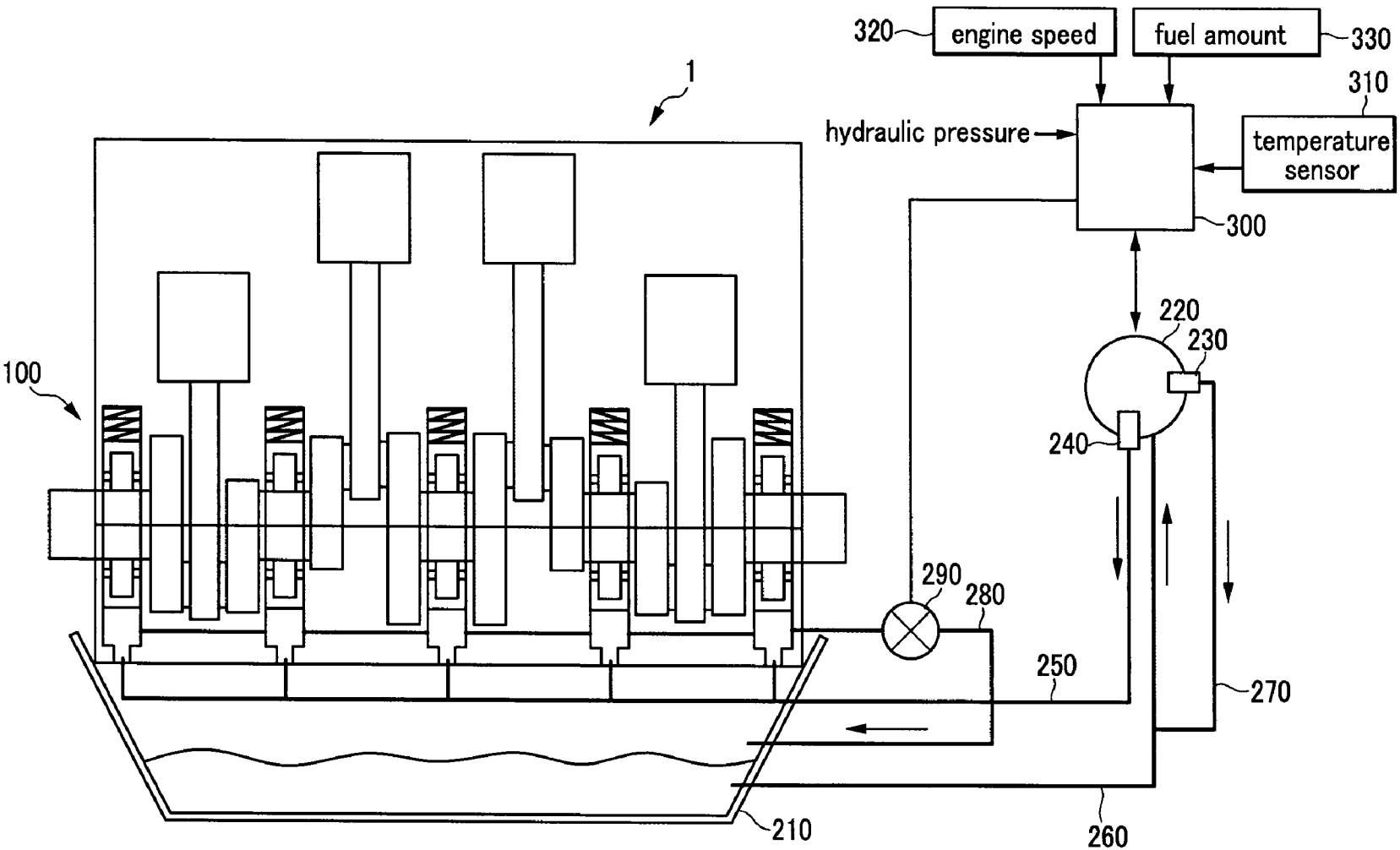
FIG. 6 is a schematic diagram of an exemplary engine using a variable compression ratio apparatus according to the present invention.

As shown in FIG. 1 to FIG. 3, a variable compression ratio apparatus 100 according to various embodiments of the present invention changes a mounting height h of a crankshaft 30 according to a driving condition of an engine 1 (referring to FIG. 6).

The engine 1 includes a cylinder head H and a cylinder block B, and the cylinder block B includes an upper cylinder block 10 and a lower cylinder block 15. The cylinder head H is provided with an ignition device, an intake valve, an exhaust valve, and a valve control device.

In addition, a cylinder is formed in the engine 1 and a piston 20 is inserted in the cylinder so as to form a combustion chamber between the cylinder and the piston 20.

The combustion chamber is connected to an intake manifold and receives an air-fuel mixture from the intake manifold. In addition, the combustion chamber is connected to an exhaust manifold and exhausts a burned air-fuel mixture to the exhaust manifold.

The piston 20 is pivotally connected to one end of a connecting rod 25, and the crankshaft 30 is eccentrically rotatably connected to the other end of the connecting rod. Therefore, a combustion force of the air-fuel mixture transmitted from the piston 20 to the connecting rod 25 is transmitted to the crankshaft 30, and thereby the crankshaft 30 rotates.

As shown in FIG. 2, the crankshaft 30 is mounted at a guide hole 115 formed at a coupling portion of the upper cylinder block 10 and the lower cylinder block 15. The guide hole 115 is shaped eccentric so that the crankshaft 30 may move upwards or downwards along this guide hole 115 as explained in the following. In various embodiments of the present invention, hollow bearings 70 and 75 respectively having a semi-cylindrical shape may be mounted in the guide hole 115 of the cylinder block B and the crankshaft 30 is rotatably inserted therein such that the crankshaft 30 may move upwards or downwards along the hollow bearings 70 and 75. The hollow bearings 70 and 75 may reduce friction occurring when the crankshaft 30 rotates. Cross-sections of the bearings 70 and 75 respectively have semi-elliptical shapes where a vertical axis is longer than a horizontal axis such that the crankshaft 30 can move upwardly or downwardly in the bearings 70 and 75. FIG. 2 shows that the upper bearing 70 and the lower bearing 75 are separately manufactured and then assembled. However, the upper bearing 70 and the lower bearing 75 may be manufactured integrally. In addition, an upper penetration hole 80 (referring to FIG. 3) is formed at an upper portion of the upper bearing 70 and a lower penetration hole 85 (referring to FIG. 3) is formed at a lower portion of the lower bearing 75.

Further, the variable compression ratio apparatus 100 is mounted in the cylinder block B.

The variable compression ratio apparatus 100 according to various embodiments of the present invention includes an operating cylinder 35, an operating piston 40, a lower roller 45, a mounting hole 50, an elastic member 55, an upper piston 60, and an upper roller 65.

The operating cylinder 35 is formed in the lower cylinder block 15 and is connected to a hydraulic pump 220 (referring to FIG. 6) so as to receive hydraulic pressure.

The operating piston 40 is installed in the operating cylinder 35 and receives the hydraulic pressure such that the operating piston 40 can move upwardly or downwardly in the operating cylinder 35. The lower roller 45 is rotatably connected to the operating piston 40 by connecting means such as a pin 42. The operating cylinder 35 may include a spacer 95 therein to space the operating piston 40 from a bottom portion of the operating cylinder 35 so that the hydraulic pressure can be supplied to the operating piston 40 with little pressure variation.

The lower roller 45 is used for reducing frictional force between the operating piston 40 and the crankshaft 30. An exterior circumference of the lower roller 45 penetrates the lower penetration hole 85 and contacts the crankshaft 30. When the crankshaft 30 rotates, the lower roller 45 also rotates. Therefore, friction may be reduced.

The mounting hole 50 is formed in the upper cylinder block 10.

The upper piston 60 is mounted in the mounting hole 50. The elastic member 55 is interposed between the upper piston 60 and the mounting hole 50, and always exerts elastic force on the upper piston 60 downwardly in the drawings. Therefore, the upper piston 60 can move upwardly or downwardly in the mounting hole 50 by the elastic force and the hydraulic pressure. In addition, the upper roller 65 is rotatably connected to the upper piston 60 by connecting means such as a pin 62.

The upper roller 65 is used for reducing frictional force between the upper piston 60 and the crankshaft 30. An exterior circumference of the upper roller 65 penetrates the upper penetration hole 80 and contacts the crankshaft 30. When the crankshaft 30 rotates, the upper roller 65 also rotates. Therefore, friction may be reduced.

In a case in which the engine 1 operates in a high compression ratio region, the hydraulic pressure is supplied to the operating cylinder 35. In this case, the hydraulic pressure through the operating piston 40 and the lower roller 45 raises the crankshaft 30 by a predetermined height d (referring to FIG. 2), and thereby a high compression ratio can be achieved. The predetermined height d can be preset according to the fuel amount and the engine speed (referring to FIG. 7).

In a case in which the engine 1 operates in a low compression ratio region, the hydraulic pressure is returned from the operating cylinder 35. In this case, the crankshaft 30 is moved downwardly by the elastic force of the elastic member 55 exerted through the upper piston 60 and the upper roller 65, and thereby a low compression ratio can be achieved.

Hereinafter, referring to FIG. 4 and FIG. 5, a variable compression ratio apparatus according to various embodiments of the present invention will be described in detail. The variable compression ratio apparatus according to various embodiments of the present invention is similar to the variable compression ratio apparatus according to various embodiments of the present invention. Therefore, the same constituent elements are denoted by the same reference numerals, and a detailed description thereof will be omitted.

Figure 4:
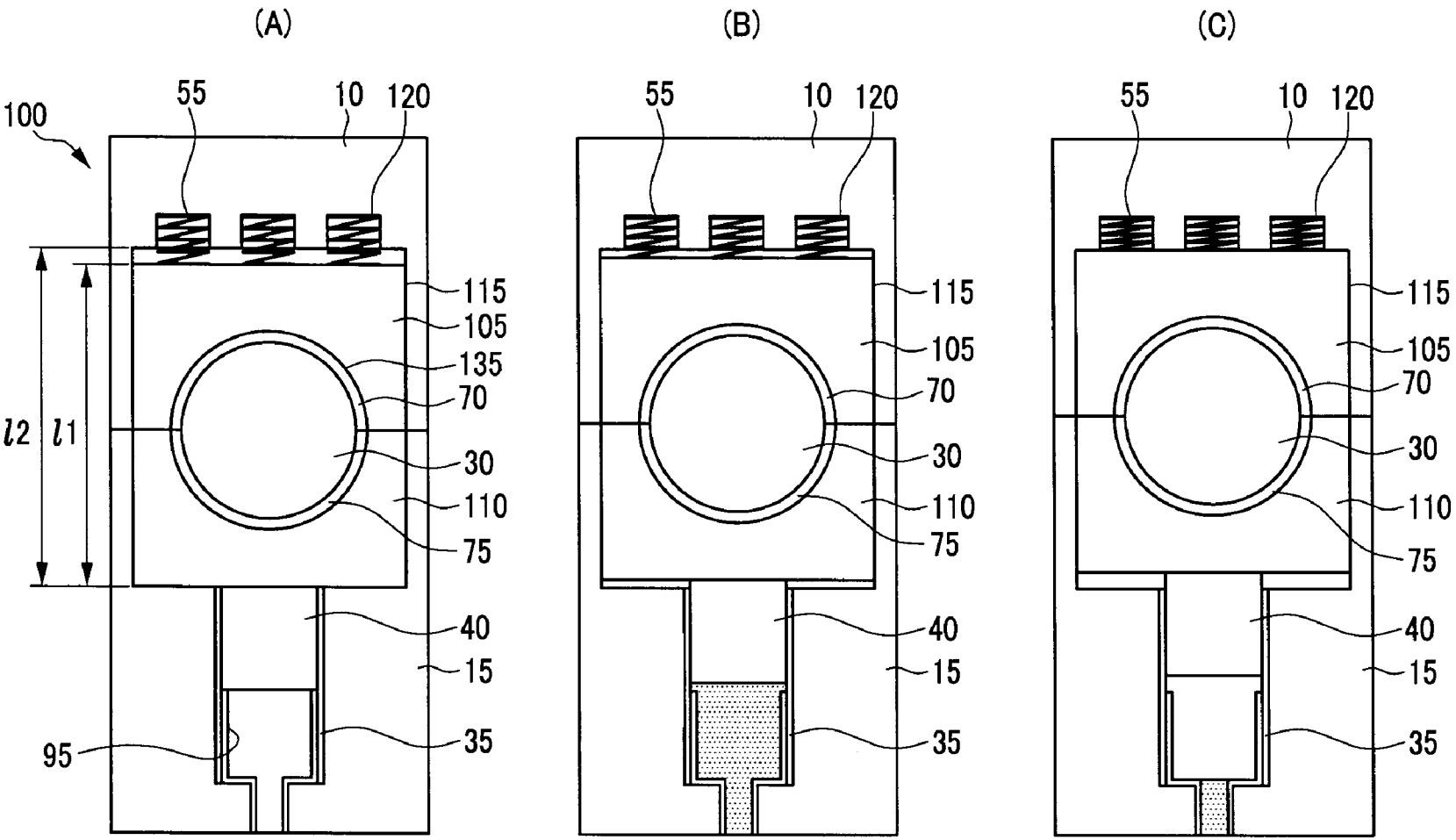
FIG. 4 is a side cross-sectional view of another exemplary variable compression ratio apparatus according to the present invention.
Figure 5:
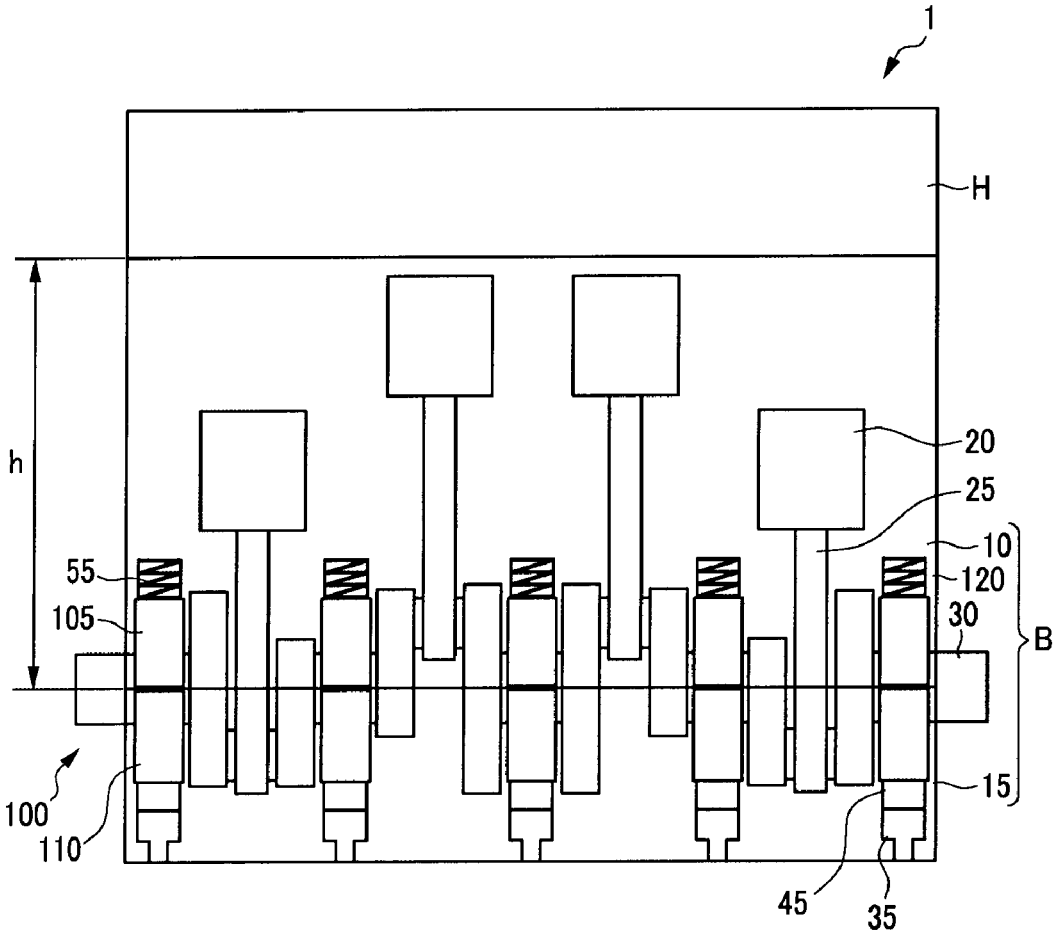
FIG. 5 is a schematic diagram of the variable compression ratio apparatus of FIG. 4.

FIG. 4 is a side cross-sectional view of a variable compression ratio apparatus according to various embodiments of the present invention, and FIG. 5 is a schematic diagram of a variable compression ratio apparatus according to various embodiments of the present invention.

As shown in FIG. 4 and FIG. 5, a guide hole 115 is mounted at a coupling portion of the upper cylinder block 10 and the lower cylinder block 15, and supporting members 105 and 110 are mounted in the guide hole 115. Since the height 11 of the supporting members 105 and 110 is smaller than the height 12 of the guide hole 115, the supporting members 105 and 100 can move upwardly or downwardly in the guide hole 115. FIG. 4 shows that an upper supporting member 105 and a lower supporting member 110 are separately manufactured and then assembled. However, the upper supporting member 105 and the lower supporting member 110 may be manufactured integrally.

The hollow bearings 70 and 75 respectively having a semi-cylindrical shape are mounted in a receiving hole 135 of the supporting members 105 and 110 so as to reduce friction occurring when the crankshaft 30 rotates, and the crankshaft 30 is rotatably inserted in the bearings 70 and 75. Respective cross-sections of the bearings 70 and 75 have a circular shape. As described above, the upper bearing 70 and the lower bearing 75 may be separately manufactured and then assembled, or may be manufactured integrally.

The operating cylinder 35 is formed at a lower end of the guide hole 115 so as to receive the hydraulic pressure from the hydraulic pump 220, and the operating piston 40 is installed in the operating cylinder 35 so as to move upwardly or downwardly. The upper surface of the operating piston 40 contacts a lower surface of the lower supporting member 110. In various embodiments of the present invention, the operating piston 40 and the lower supporting member 110 may be manufactured integrally.

An elastic member mounting hole 120 is formed at an upper end of the guide hole 115, and the elastic member 55 is installed in the elastic member mounting hole 120. The lower end of the elastic member 55 contacts an upper surface of the upper supporting member 105 so as to exert the elastic force on the upper supporting member 105.

In a case in which the engine 1 operates in the high compression ratio region, the hydraulic pressure is supplied to the operating cylinder 35. In this case, the hydraulic pressure through the operating piston 40 and the lower supporting member 110 raises the crankshaft 30 by the predetermined height d (referring to FIG. 2), and thereby a high compression ratio can be achieved.

In a case in which the engine 1 operates in a low compression ratio region, the hydraulic pressure is returned from the operating cylinder 35. In this case, the crankshaft 30 is moved downwardly by the elastic force of the elastic member 55 exerted through the upper supporting member 115, and thereby a low compression ratio can be achieved.

Hereinafter, referring to FIG. 6, the engine according to various embodiments of the present invention will be described in detail.

FIG. 6 is a schematic diagram of an engine using a variable compression ratio apparatus according to various embodiments of the present invention.

As shown in FIG. 6, in the engine 1 using the variable compression ratio apparatus according to exemplary embodiments of the present invention, the piston 20, the connecting rod 25, and the crankshaft 30 mounted in the cylinder block B with the cylinder head H attached thereto are the same as the conventional piston, the conventional connecting rod, and the conventional crankshaft. In addition, the variable compression ratio apparatus 100 is the variable compression ratio apparatus 100 according to exemplary embodiments of the present invention.

Further, the engine 1 includes an oil pan 210, a hydraulic pump 220, a control portion 300, and sensors 240, 310, and 320.

The oil pan 210 is disposed at a lower portion of the cylinder block B, and oil for lubricating and cooling the engine 1 is stored in the oil pan 210.

Figure 7:
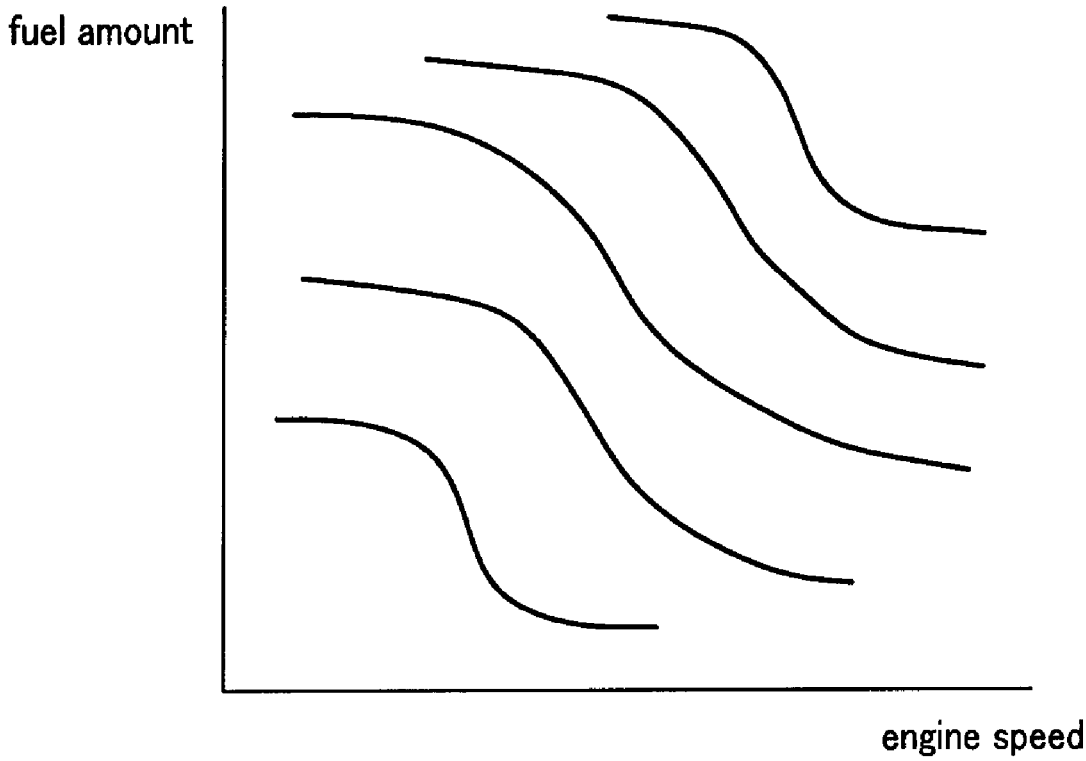
FIG. 7 shows an exemplary map of hydraulic pressure according to a fuel amount and an engine speed.

The hydraulic pump 220 receives the oil stored in the oil pan 210 through an input line 260 so as to generate a target hydraulic pressure, and supplies the target hydraulic pressure to the operating cylinder 35 through a supply line 250. A pressure sensor 240 for detecting the hydraulic pressure is mounted on the supply line 250. The target hydraulic pressure is determined by the control portion 300, and the target hydraulic pressure according to the fuel amount and the engine speed is stored in the control portion 300, as shown in FIG. 7.

In addition, a relief line 270 is connected between the hydraulic pump 220 and the input line 260 so as to exhaust excess hydraulic pressure generated in the hydraulic pump 220. A relief valve 230 is mounted on the relief line 270 and closes or opens the relief line 270.

A return line 280 is connected between one end of the operating cylinder 35 and the oil pan 210 so as to return the oil supplied to the operating cylinder 35 back to the oil pan 210. A cut-off valve 290 is mounted on the return line 280 and controls return of the oil.

The control portion 300 is electrically connected to the engine speed sensor 320 so as to receive information of the engine speed, is electrically connected to a temperature sensor 310 so as to receive information of the coolant temperature, is electrically connected to the pressure sensor 240 so as to receive information of the hydraulic pressure generated in the hydraulic pump 220, and is electrically connected to a fuel sensor 330 so as to receive information of the fuel amount supplied to the engine 1.

In addition, the control portion 300 is electrically connected to the hydraulic pump 220 and the cut-off valve 290, and controls operations of the hydraulic pump 220 and the cut-off valve 290 based on the above-mentioned information.

Hereinafter, referring to FIG. 8, operation of the engine according to various embodiments of the present invention will be described in detail.

Figure 8:
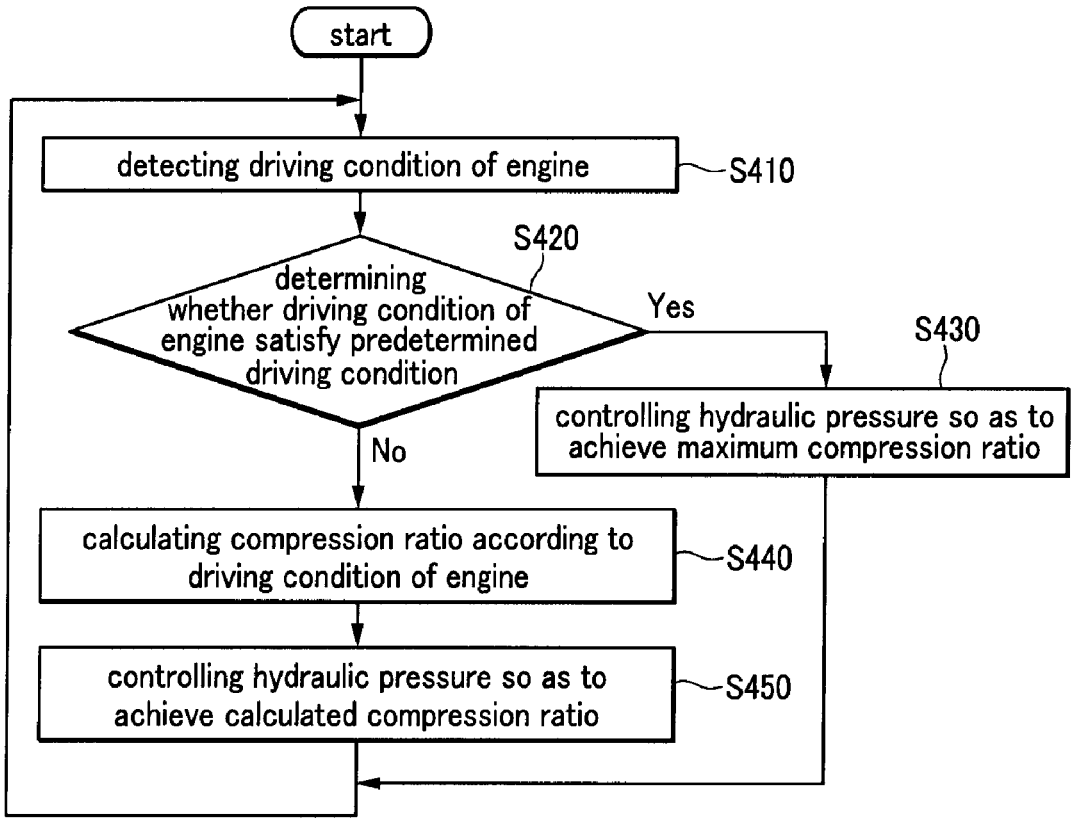
FIG. 8 is a flowchart showing an operation of an exemplary engine using a variable compression ratio apparatus according to the present invention.

FIG. 8 is a flowchart showing an operation of an engine using a variable compression ratio apparatus according to exemplary embodiments of the present invention.

When the engine 1 operates, the control portion 300 detects the driving condition of the engine 1 from the measured values of the respective sensors 240, 310, and 320 at a step S410, and determines whether the detected driving condition of the engine 1 satisfies a predetermined driving condition at a step S420. The predetermined driving condition is satisfied when the coolant temperature is lower than or equal to a predetermined temperature and the engine speed is slower than or equal to a predetermined speed. The predetermined temperature and the predetermined speed can be easily predetermined by a person of ordinary skill in the art. For example, the predetermined temperature may be 15° C. and the predetermined speed may be 200 rpm.

If the driving condition of the engine 1 satisfies the predetermined driving condition at the step S420, the control portion 300 controls the hydraulic pump 220 to generate the target hydraulic pressure for achieving a maximum compression ratio at a step S430.

If the driving condition of the engine 1 does not satisfy the predetermined driving condition at the step S420, the control portion 300 calculates the compression ratio according to the driving condition of the engine 1 at a step S440.

After that, the control portion 300 controls the hydraulic pump 220 to generate the target hydraulic pressure for achieving the calculated compression ratio at a step S450.

Meanwhile, step S410 to step S450 may be iteratively performed while the engine 1 operates.

As described above, since the present invention can control the compression ratio of an air-fuel mixture according to a driving condition of an engine, fuel consumption and output may be improved.

For convenience in explanation and accurate definition in the appended claims, the terms "upper", "lower", "upwards, and "downwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus for an engine receiving a combustion force of an air-fuel mixture from a piston so as to rotate a crankshaft, the apparatus comprising:

cylinder blocks between which the crankshaft is movably disposed, the cylinder blocks being configured and dimensioned to change a position of a rotation center of the crankshaft such that the compression ratio of the air-fuel mixture is changed by the position of the rotation center of the crankshaft according to a driving condition of the engine;

a guide hole formed through bodies of the cylinder blocks and slidably receiving the crankshaft therein so as to allow upward and downward movements of the crankshaft to change the rotation center of the crankshaft;

an operating cylinder formed through a body of one of the cylinder blocks and connected to the guide hole and receiving hydraulic pressure according to driving condition of the engine; and an operating piston slidably mounted in the operating cylinder and engaged with the camshaft to selectively press a portion of the crankshaft to change the rotation center of the crankshaft by the hydraulic pressure.

2. The variable compression ratio apparatus of claim 1, wherein the operating cylinder includes a spacer therein to maintain a gap between the operating piston and a inlet portion of the hydraulic pressure supplied through the operating cylinder.

3. The variable compression ratio apparatus of claim 2, further comprising:

a mounting hole formed to the other one of the cylinder blocks;

an elastic member disposed in the mounting hole and exerting elastic force against the hydraulic pressure to the crankshaft; and an upper piston slidably disposed in the mounting hole and supported by the elastic member so as to supply the elastic force to the crankshaft.

4. The variable compression ratio apparatus of claim 3, wherein a hollow bearing having substantially the same shape of the guide hole is mounted in the guide hole of the cylinder blocks, and wherein the crankshaft is rotatably inserted in the bearing.

5. The variable compression ratio apparatus of claim 4, wherein the guide hole and the hollow bearing are shaped eccentric such that the crankshaft is configured and dimensioned to be slidably movable therein.

6. The variable compression ratio apparatus of claim 4, wherein upper and lower rollers are rotatably mounted respectively at the upper piston and the operating piston, and wherein the upper and lower rollers rotatably contact with the crankshaft respectively through upper and lower penetration holes formed on the hollow bearing.

7. The variable compression ratio apparatus of claim 2, further comprising at least an elastic member exerting elastic force against the hydraulic pressure.

8. The variable compression ratio apparatus of claim 7, further comprising a supporting member mounted in the guide hole of the cylinder block and configured and dimensioned to move upwardly or downwardly therein, wherein the crankshaft is rotatably inserted in a receiving hole of the supporting member so as to move together with the supporting member.

9. The variable compression ratio apparatus of claim 8, wherein the elastic members are disposed between upper portion of the guide hole and the supporting member and are aligned symmetric with respect to the center axis of the supporting member in a longitudinal direction of the supporting member and exerting an elastic force against the hydraulic pressure to the supporting member.

10. The variable compression ratio apparatus of claim 8, wherein the operating piston contacts with a lower surface of the supporting member and the elastic member contacts with an upper surface of the supporting member such that the operating piston and the elastic member respectively exert the hydraulic pressure and the elastic force opposing each other to the supporting member.

11. The variable compression ratio apparatus of claim 10, wherein the supporting member and operating cylinder are monolithically formed.

12. The variable compression ratio apparatus of claim 8, wherein a hollow bearing is disposed in the receiving hole of the supporting member.

13. The variable compression ratio apparatus of claim 12, wherein the supporting member includes an upper supporting member and a lower supporting member coupled to the upper supporting member and the bearing is disposed in the receiving hole formed in the upper and lower supporting members.

* * * * *